US008968011B2

(12) United States Patent
Hoffmeister

(10) Patent No.: US 8,968,011 B2
(45) Date of Patent: Mar. 3, 2015

(54) POWER TRACK

(71) Applicant: Oliver Hoffmeister, Luedenscheid (DE)

(72) Inventor: Oliver Hoffmeister, Luedenscheid (DE)

(73) Assignee: Hoffmeister Leuchten GmbH, Schalksmuehle (DE)

( * ) Notice: Subject to any disclaimer, the term of this patent is extended or adjusted under 35 U.S.C. 154(b) by 58 days.

(21) Appl. No.: 13/859,567

(22) Filed: Apr. 9, 2013

(65) Prior Publication Data

US 2013/0273758 A1 Oct. 17, 2013

(30) Foreign Application Priority Data

Apr. 11, 2012 (DE) ..... 10 2012 007 083

(51) Int. Cl.
*H01R 25/14* (2006.01)

(52) U.S. Cl.
CPC ..... *H01R 25/14* (2013.01); *H01R 25/142* (2013.01)
USPC ..... 439/110

(58) Field of Classification Search
USPC ..... 439/110, 116, 117, 118
See application file for complete search history.

(56) References Cited

U.S. PATENT DOCUMENTS 3,531,758 A * 9/1970 Blumkin ..... 439/213
3,718,816 A * 2/1973 Seelbach et al. ..... 362/394
3,760,133 A * 9/1973 Howard ..... 200/50.28
3,900,240 A * 8/1975 Bertrams et al. ..... 439/139
3,933,403 A * 1/1976 Rubesamen et al. ..... 439/121
3,973,818 A * 8/1976 Soquenne ..... 439/115
4,211,460 A * 7/1980 Seelbach et al. ..... 439/338
4,279,456 A * 7/1981 Zucchini ..... 439/262
4,822,292 A * 4/1989 Thayer et al. ..... 439/207
4,919,625 A * 4/1990 Coutre ..... 439/118
5,869,786 A * 2/1999 Jaakkola et al. ..... 174/96
6,170,967 B1 * 1/2001 Usher et al. ..... 362/394
6,274,817 B1 * 8/2001 Jaakkola et al. ..... 174/96
7,520,763 B1 * 4/2009 Buse ..... 439/121
2013/0273757 A1 * 10/2013 Hoffmeister ..... 439/111

FOREIGN PATENT DOCUMENTS

DE 2250738 A 4/1974

* cited by examiner

*Primary Examiner* — Neil Abrams
(74) *Attorney, Agent, or Firm* — Andrew Wilford

(57) ABSTRACT

A metal power track has a U-section body having a pair of parallel side walls joined by a floor wall and delimiting a longitudinally extending retaining channel. Respective longitudinally extending and dielectric support rails are carried on the side walls, and a ground strip is provided on the floor wall. Two respective longitudinally extending, uninsulated bare main conductors are carried on each of the the dielectric support rails and are adapted to conduct power. Respective longitudinally extending uninsulated secondary conductors are carried on each of the dielectric support rails between the respective main conductors but out of electrical contact therewith. The conductors are all exposed transversely in the retaining channel. Each of the secondary conductors is adapted to carry electrical control signals or act as light-duty power feed lines.

7 Claims, 1 Drawing Sheet

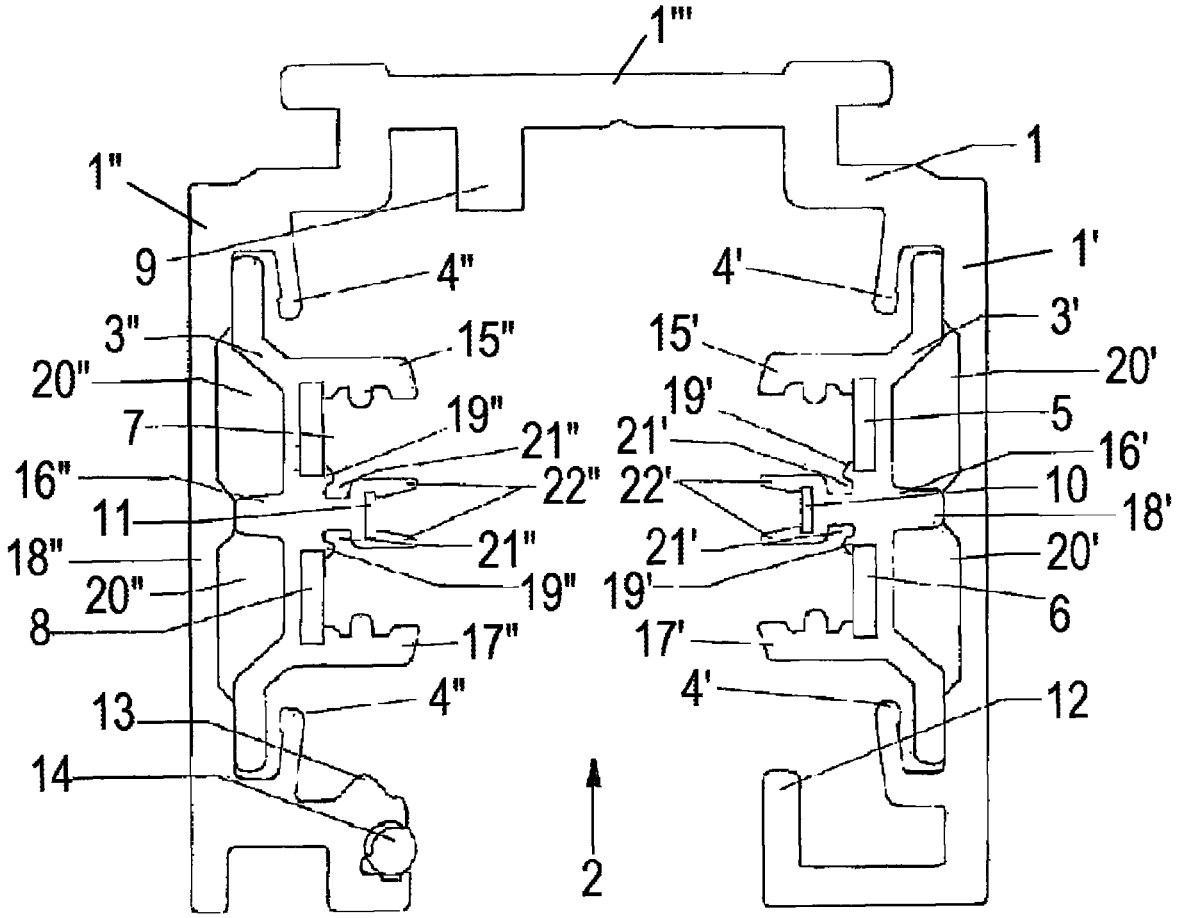
1'''
1
1"
1'
9
4"
4'
3"
3'
15"
15'
20"
20'
7
19"
19'
5
21"
21'
16'
16"
22"
22'
10
11
18'
18"
21"
21'
20'
20"
19"
19'
8
6
17"
17'
4"
4'
13
12
14
2

POWER TRACK

FIELD OF THE INVENTION

The present invention relates to a power track. More particularly this invention concerns such a rail used to supply electricity to an electrical device, such as a ceiling-mounted lamp.

BACKGROUND OF THE INVENTION

A typical power track has a U-section metal body having parallel side walls that laterally delimit a retaining channel and carry respective dielectric support rails in turn each carrying a respective plurality of uninsulated, bare electrical conductors that are insulated from one another, parallel to one another in the rail longitudinal direction, opposite one another, and exposed in the retaining channel, three of the conductors being used as phase conductors and one being used as neutral conductor. Aground conductor is also exposed in the retaining channel also preferably being provided on a base of the power track.

Such a power track may be found for instance in FIG. 3 of DE OS 22 50 738.

OBJECTS OF THE INVENTION

It is therefore an object of the present invention to provide an improved power track that overcomes the above-given disadvantages.

More particularly the object is to provide a power track of this type that, in addition to three-phase rotary current operation also permits the additional connection of other consumers or of signal transmissions.

SUMMARY OF THE INVENTION

A metal power track has according to the invention a U-section body having a pair of parallel side walls joined by a floor wall and delimiting a longitudinally extending retaining channel. Respective longitudinally extending and dielectric support rails are carried on the side walls, and a ground strip is provided on the floor wall. Two respective longitudinally extending, uninsulated bare main conductors are carried on each of the dielectric support rails and are adapted to conduct power. Respective longitudinally extending uninsulated secondary conductors are carried on each of the dielectric support rails between the respective main conductors but out of electrical contact therewith. The conductors are all exposed transversely in the retaining channel. Each of the secondary conductors is adapted to carry electrical control signals or act as light-duty power feed lines.

This arrangement makes it possible not only for the three phase and neutral main conductors to be used as connectors for the phases during three-phase rotary current operation, but also for other consumers, for instance emergency light, safety illumination, other low-voltage consumers or even alternating current consumers, signal transmission, and the like to be connected using the secondary conductors.

In a manner known per se, support formations for an adapter inserted into the power track are formed on the outer edges of the side walls remote from the base of the power track, one of these support formations preferably holding a bare ground conductor that is exposed in the retaining channel.

The arrangement of another ground conductor in one of these support formations is an option that is provided depending on the design of the adapter and that is compatible with the power track. Normally a ground conductor is eccentrically provided on the floor of the power track, as is known from the prior art cited above. Additionally or alternatively, a ground conductor may be mounted in the support formation of the power track, typically as a bare wire set in a longitudinal inwardly open groove thereof.

In order to provide an arrangement in which creep voltages flowing between the phase and neutral main conductors and the secondary conductors are suppressed, each dielectric support rail has seat grooves delimited by a first outer bar, a center bar, and a second outer bar for receiving a phase conductor and/or neutral conductor, the center bar being forked in a U-shape at its inner edge remote from the respective side wall of the power track to which the support rail is fixed, and the secondary conductors are into the respective forks so as to be positioned at the base of the respective fork while the fork legs project sufficiently beyond the secondary conductor to prevent creep voltages to the phase or neutral conductors.

This embodiment ensures that creep voltage losses can be prevented. Moreover, to improve this behavior the center bar can be of reduced thickness in the area between its base and the insulating clips holding the phase conductors or the neutral conductor for forming an extended creep-voltage flow path.

In addition, in a manner known per se an air gap is formed between the dielectric support rail and the side wall holding it, at least at the phase conductors or the neutral conductor.

Preferably also the support rails each hold the two phase conductors or one phase conductor and the neutral conductor in an outer plane lying parallel to the side wall of the power track and the secondary conductors each lie in an intermediate plane that is offset toward the interior of the power track with respect to this outer plane.

Also preferably the outer edges of the first and second outer bars and the ends of the fork legs of the center bar lie in an inner plane that extends parallel to the side walls of the power track.

Moreover, the phase conductors, the neutral conductor, and the secondary conductors are protected from manual contact by being recessed in the respective support rails.

According to one special characteristic the end of the power track is fitted with a connector, input, or end piece formed as a coupling that is made of insulating material and has a connecting conductor that is in contact with the phase conductors, the neutral conductor, the secondary conductors, and with a ground contact, parts of the coupling made of insulating material engaging in cavities of the power track that are formed between the support rail and the side walls of the power track and in a space that is formed between a support bar for the secondary conductor and the insulating bar adjacent thereto that holds the area of each phase conductor or of the neutral conductor that is adjacent the support bar.

The inventively power track can both be connected to a three-phase current and also permit connection to signal transmission and the like. In one conventionally accepted design of the power track, for instance, 3×16 amperes can be connected via the phase conductors for three-phase rotary current operation. In addition, a load with 10 amperes for other conductors may be accommodated using the secondary conductors, or alternatively they may be used for signal transmission or other installations. The air gap and creep paths are retained.

BRIEF DESCRIPTION OF THE DRAWING

The above and other objects, features, and advantages will become more readily apparent from the following description, reference being made to the accompanying drawing whose sole FIGURE is an end view of the power track according to the invention.

DETAILED DESCRIPTION OF THE INVENTION

As seen in the drawing a power track 1 made of metal is basically of U-section. Parallel and planar side walls 1 and 1' of the power track flank a retaining channel 2 that is delimited at the top side by a base or floor wall 1''' of the power track 1. Support rails 3' and 3" made of insulating material are mounted on the side walls 1' and 1" of the power track 1 and fixed in place by deformable bar or flanges 4' and 4" unitarily formed with the side walls 1' and 1". These support rails 3' and 3" each receive a is respective pair uninsulated bare electrical conductors 5, 6, and 7, 8 that are insulated from one another, extend parallel to one another in the longitudinal direction of the rail, are opposite one another, and are exposed in the retaining channel 2. Of these conductors, three are used as phase conductors, for instance the conductors 5, 6, 7. One of these conductors is used as a neutral conductor, for instance the conductor 8. In addition, formed or provided in the illustrated embodiment on the floor wall 1''' of the power track 1 is a ground conductor 9 that is also exposed in the retaining channel 2.

Arranged between each conductor pair 5, 6 or 7, 8 that is held in a support rail 3' or 3", insulated from the side pairs of the respective conductors 5, 6 or 7, 8, are a fifth conductor 10 and a sixth conductor 11 that are transversely opposite one another. Again, both conductors 10 and 11 on the side walls 1' and 1" are exposed in the retaining channel 2. These fifth and sixth conductors 10, 11 may be used for instance as control conductors for electrical or electronic controls or may even be connected to a power supply as an additional power conductor for other electrical consumers.

Support formations 12, 13 for an adapter inserted into the power track 1 are formed on the outer edges of the respective side walls 1' and 1" remote from the floor wall 1''' of the power track 1. In the illustrated embodiment, one of these support formations, specifically the support formation 13, is fitted with an additional bare ground conductor 14 that is exposed in the retaining channel 2.

Each support rail 3' and 3" made of insulating material has grooves delimited by a respective first outer bar 15' or 15", a center bar 16' or 16", and a second outer bar 17' or 17", for receiving the phase or neutral conductors 5, 6, 7, 8. The center bars 16' and 16" are forked in approximately a U-shape at their outer edges remote from the respective side wall 1' or 1" to which the respective support rail 3' and 3" is fixed, the fifth or sixth conductor 10, 11 being inserted into the fork so as to lie at the base of the fork and the respective fork legs 22' and 22" project sufficiently beyond the fifth and sixth conductors 10, 11 to prevent creep voltages between the conductors 5, 6, and 10 or 7, 8, and 11.

The center bars 16' and 16" are of reduced thickness in the area between their bases 18' and 18" and respective insulating clips 19 holding the phase conductor 5, 6, or 7 or the neutral conductor 8 for forming an extended creep-voltage flow path.

Empty spaces or cavities 20' and 20" are formed between the dielectric support rail 3' and 3" and the respective side wall 1' and 1" of the power track 1 holding it at the phase conductors 5, 6, 7 or neutral conductor 8.

As may be seen from the drawing, the support rails 3' and 3" carry the two phase conductors 5, 6 or the phase conductor 7 and the neutral conductor 8 in an outer plane extending parallel to the respective side wall 1' or 1" of the power track 1. The fifth is conductor 10 and the sixth conductor 11 are each arranged in an intermediate plane that is offset toward the interior of the power track 1 with respect to the outer plane. This makes it possible for the additional fifth and sixth conductors 10, 11 to be arranged inside the power track 1 and to provide enough distance between the conductors to prevent leak currents.

The outer edges of the first and second outer bars 15' or 15", 17' or 17" and the ends of the fork legs 22 of the center bar 16' or 16" lie in an inner plane that also extends parallel to the side walls 1' and 1" of the power track 1. The inner, intermediate, and outer planes are all parallel and parallel to the planes of the side walls 1' and 1".

All the conductors, that is, the phase conductors 5 through 7, the neutral conductor 8, and the fifth and sixth conductors 10, 11, are protected from manual contact in that they are recessed in the respective support rails 3' and 3".

Not shown in the drawing is a coupling or the like that is inserted into the end of the power track 1 as a connector, input, or end piece. Such a coupling is largely of insulating material and has contacts engaging the phase conductors, the neutral conductor, the fifth and sixth conductors, and a ground contact of the power track 1 when it is inserted into the power track.

When assembled in this way, parts of a dielectric coupling engage in the chambers 20' and 20" of the power track 1 that are formed between the support rail 3 and the side walls 1' and 1" of the power track 1 and in spaces 21 formed between the support bar for the fifth conductor 10 or sixth conductor 11 and the insulating bars 19' and 19" adjacent thereto that holds parts of each phase conductor 5, 6, 7 or of the neutral conductor 8 that is adjacent to the support bar. What this arrangement achieves is that the air gap is extended at the separation joint between the end of the power track 1 and the coupling inserted therein in terms of the air gap between the contacts so that a high degree of operational reliability is attained.

The invention is not limited to the illustrated embodiment, but rather may vary widely within the context of the disclosure.

All of the individual and combined features disclosed in the description and/or drawing are considered essential to the invention.

I claim:

1. A metal power track comprising:

a U-section body having a pair of parallel side walls joined by a floor wall and delimiting a longitudinally extending retaining channel;

respective longitudinally extending and dielectric support rails carried on the side walls and each formed with two transversely spaced and longitudinally extending outer bars projecting inward toward the retaining channel and a longitudinally extending center bar between the outer bar, defining with the respective outer bars two outer grooves, and formed with a bifurcated inner end forming an inner groove;

a ground strip provided on the floor wall;

respective longitudinally extending, uninsulated bare main conductors adapted to conduct power and each held in a respective one of the outer grooves;

respective longitudinally extending uninsulated secondary conductors held in the inner grooves between the respective main conductors but out of electrical contact therewith, the conductors all being exposed transversely in the retaining channel, inner edges of the bars and of the bifurcated inner end extending inward of the respective conductors, each of the secondary conductors being adapted to carry electrical control signals or act as light-duty power feed lines.

2. The power track defined in claim 1, wherein the body is further formed with:

support formations formed on outer edges of the side walls and adapted for engagement with an adapter transversely fittable into the retaining channel, one of the formations being provided with a bare ground conductor exposed in the retaining channel.

3. The power track defined in claim 1 wherein the center bars are each of reduced thickness between the respective outer groove and the respective secondary conductor.

4. The power track defined in claim 1, wherein the secondary conductors lie in planes spaced inwardly between planes in which the respective main conductors lie, the planes being parallel to the side walls and one another.

5. The power track defined in claim 4, wherein the inner edges of the bars lie in planes inward of the planes of the respective conductors.

6. The power track defined in claim 5, wherein the conductors are recessed in the respective dielectric support rails, whereby they are protected from manual contact.

7. The power track defined in claim 1, wherein each dielectric support bar is spaced inwardly from and forms a longitudinally extending empty cavity with the respective side wall.

* * * * *